United States Patent [19]

Shiga et al.

[11] Patent Number: 4,898,318

[45] Date of Patent: Feb. 6, 1990

[54] COPPER RADIATOR FOR MOTOR CARS EXCELLENT IN CORROSION RESISTANCE AND METHOD OF MANUFACTURING THE SAME

[75] Inventors: Syoji Shiga; Akira Matsuda; Nobuyuki Shibata; Kiichi Akasaka, all of Nikko, Japan

[73] Assignees: The Furukawa Electric Co., Ltd., Tokyo; Nippondenso Co., Ltd., Kariya, both of Japan

[21] Appl. No.: 177,066

[22] Filed: Apr. 4, 1988

Related U.S. Application Data

[62] Division of Ser. No. 903,948, Sep. 5, 1986, Pat. No. 4,775,004.

[51] Int. Cl.[4] ..... B23K 1/14

[52] U.S. Cl. ..... 228/183; 228/199; 228/202; 228/219; 228/220

[58] Field of Search ..... 228/183, 220, 219, 214, 228/199, 202; 148/11.5 C

[56] References Cited

U.S. PATENT DOCUMENTS

| | | | |
|---|---|---|---|
| 2,117,106 | 5/1938 | Silliman | 228/220 X |
| 4,451,541 | 5/1984 | Beal | 228/220 X |
| 4,492,602 | 1/1985 | Lee et al. | 148/11.5 C |

FOREIGN PATENT DOCUMENTS

| | | | |
|---|---|---|---|
| 568659 | 4/1945 | United Kingdom | 228/183 |

*Primary Examiner*—Kenneth J. Ramsey

*Attorney, Agent, or Firm*—Oblon, Spivak, McClelland, Maier & Neustadt

[57] ABSTRACT

An improved copper radiator for motor cars comprising a plurality of tubes adapted for the flow of a heat-exchanging medium therethrough, fins bonded directly with solder to said tubes to form a copper core and wherein said core is bonded with solder to at least one seat plate, the improvement in that the surface of the fins of said copper radiator has an oxidized layer of a thickness of not more than 1200 Å.

7 Claims, 1 Drawing Sheet

COPPER RADIATOR FOR MOTOR CARS EXCELLENT IN CORROSION RESISTANCE AND METHOD OF MANUFACTURING THE SAME

This is a division of application S.N. 06/903,948, filed Sept. 5, 1986, now U.S Pat. No. 4,775,004, granted Oct. 4, 1988.

BACKGROUND OF THE INVENTION

The present invention relates to a copper radiator for motor cars wherein corrosion resistance of the fins is improved, and lightening in weight and high performance of the radiator is effected, and to a method for its manufacture.

The purpose of a radiator in motor cars is to cool the heat-exchanging medium by a stream of air passing therethrough. It is constructed generally as shown in FIG. 1, wherein fins (2) greatly expanding the cooling aid radiation area are provided between many flat tubes (1), at least one surface of the tubes or fins is covered with brazing material, and these tubes and fins are temporarily assembled. Then, this temporary assemblage is dipped into a flux solution or the flux solution is coated onto the surface thereof and thereafter the assemblage is heated in an air atmosphere. Then the brazing material is allowed to melt by this treatment and the molten brazing material is spread sufficiently all over the contact places of the tubes with the fins, it is allowed to solidify and bonding of tubes to the fins is effected to form core (3).

The flux adhered on the surface of the temporary assemblage functions also to remove the oxidized film produced on the surface thereof and to improve the wettability of the brazing material when the temporary assemblage is heated in the atmospheric air.

Further, seat plates (4) and (4') are fitted to one end or both ends of said core (3) (fitting to both ends is shown in the Figure) by soldering and tanks (5) and (5') are connected to these seat plates. In general, for the tubes, copper alloys, such as brass, etc., are used. For the fins, thin plates made from high heat-conductive copper or copper alloys such as Cu-Sn, Cu-Cd, Cu-Zr, Cu-Ag, etc., subjected to a corrugation or louver treatment are used, and, for the seat plates, brass plates are used. Also, for the tanks, those made from brass have been used and connected by soldering, but resinous tanks have recently been used for lightening in weight and being connected by mechanical crimping.

Recently, in view of the demand for lightening in weight and high performance of the total car, lightening and high performance of the radiator for motor cars also have been investigated. As a result, thinning and the high densification of fins are regarded as effective means, and, for the fins, a plurality of thin plates (thickness: 0.02-0.05 mm) made from high heat-conductive copper alloys aforementioned is used. Although copper and copper alloys are excellent in corrosion resistance when originally installed, with the recent advent of the use of much chloride as a snow-melting agent, corrosion due to snow damage has become a serious problem with the radiator. Thus, the snow-melting agent scattered in large quantities sticks to the radiator and corrodes the fins at an extraordinarily high rates so as to decrease the effective radiation area resulting in a drastic lowering in the performance of the radiator in a short period of time.

Moreover, by the method as described above, since the temporary assemblage is heated in atmospheric air, relatively large amounts of oxidized film are produced on the surface of the temporary assemblage in a short period of time. Thus, there arises a problem that, if the oxidized film is produced in large amounts, an excess of flux becomes necessary and, the greater the amount of flux, the more of the flux decomposes thermally, inducing malodor.

Further when the molten brazing material solidifies and the bonding of tubes with fins is completed, the assemblage should be washed to wash out the flux remaining behind on the surface thereof. However, as described above, if an excess amount of flux is used, the heavy metals in the flux flow out into the wash effluent at an increasing rate causing effluent contamination.

In order to prevent this, various methods have been investigated, but all of them are insufficient. For example, coated film with a thickness of more than 0.01 mm becomes necessary. Prevention by coating, however, practically is inferior because of an increase in weight and a rise in cost. Moreover, if fins are formed with Cu-10% Ni alloy known as a corrosionresistant copper alloy to make fins more corrosionresistant, the radiation property significantly decreases with a plate of same thickness. Thus, when comparing by the electroconductivity proportional to the thermal conductivity, the relation being known as the Wiedemann-Franz's law, Cu-10% Ni alloy shows less than 10% IACS to 90 to 80% IACS with usual fin materials.

The invention provides methods of economically manufacturing a copper radiator for motor cars of high performance and withstanding corrosion due to snow damage, and at the same time lightening the car and no malodor and effluent contamination being present.

SUMMARY OF THE INVENTION

An improved copper radiator for motor cars is disclosed comprising a plurality of tubes adapted for the flow of a heat-exchanging medium therethrough, fins bonded directly with solder to said tubes to form a copper core and wherein said core is bonded with solder to at least one seat plate, wherein the improvement is that the surface of the fins of said copper radiator has an oxidized layer of a thickness of not more than 1200Å.

The heat-exchanger of the invention is prepared in that the soldering for the formation of the core is carried out in a nonoxidative atmosphere, and/or the core is submitted to reduction treatment by heating in a reductive atmosphere during assembly of the radiator after soldering for the formation of the core so as to control the thickness of oxidized film on the surface of fins to be not more than 1200 Å after assembly of the radiator.

Further, in assembling of radiator, the core can be submitted to a dipping treatment into a copper oxide-dissolvable or reducible solution during assembly of the radiator after the formation of core so as to make the thickness of oxidized film on the surface of fins to be not more than 1200 Å after assembly of the radiator.

Further, a rust inhibitor can be adsorbed or adhered onto the surface of the fins.

Figure 1:
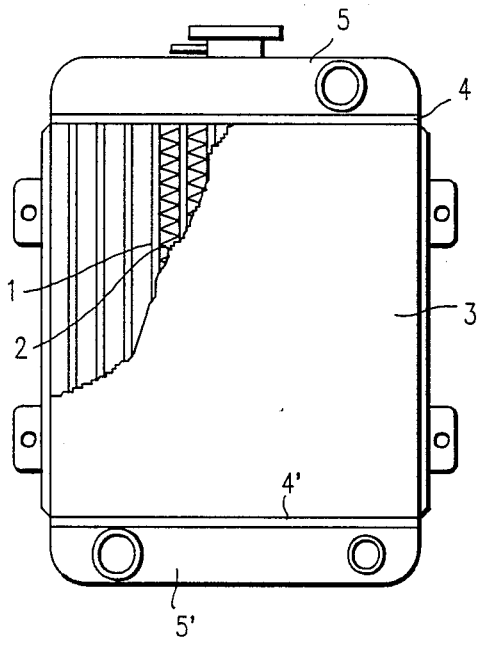
FIG. 1 is a front view showing an example of the radiator for motor cars.

DETAILED DESCRIPTION OF THE INVENTION.

The oxidized film produced on the surface of fins is a significant factor in the promotion of corrosion. Applicants have discovered that when the thickness of oxidized film exceeds 1200 Å, corrosion due to the salt damage is accelerated and the extent thereof increases with an increase in the thickness of film.

In the process according to the invention of manufacturing the radiator aforementioned, the bonding with solder for the formation of -core is carried out in a nonoxidative atmosphere, and/or the core is reduced by heating in a reductive atmosphere during assembly of the radiator after soldering for the formation of core, or the core is dipped into a copper oxide-dissolvable or reducible solution, the thickness of the oxidized film on the surface of fins is controlled to be not more than 1200 Å after assembly of the radiator.

Thus, in the usual manufacturing process, the temperature of the high-temperature furnace, where the soldering is made for the formation of core, is 300 to 400° C. and an oxidized film with a thickness of 2,000 to 10,000 Å is produced. Although the inside of said furnace is diluted somewhat with the vapor of flux etc., it is virtually an atmosphere of air. Therefore, the fins are oxidized easily. The oxidation of fins according to the invention is prevented by carrying out the soldering for the formation of core in a nonoxidative atmosphere, and/or the oxidized film produced on the surface of fins is reduced by submitting the core to reduction treatment by heating in a reductive atmosphere during assembly of the radiator after soldering for the formation of core. For the non-oxidative atmospheres, $N_2$, $H_2$, CO, $CO_2$, $H_2O$, or mixtures of these gases are used. For the reductive atmospheres, $H_2$, CO or gases having these as effective ingredients are used, and the reduction is conducted by heating to higher than 150° C.

Alternatively, the core can be submitted to dipping treatment for dissolution or reduction into a solution dissolving or reducing copper oxide during assembly of the radiator after, for example, the formation of the core or a dazzle-preventive coating.

As the copper oxide-dissolvable solutions, dilute aqueous solutions of sulfuric acid, hydrochloric acid, etc. or complex-formable aqueous solutions of ammonia, cyanides, ethylenediamine tetraacetate (EDTA), methylaminenitrilotriacetate (NTA), etc. can be used. Moreover, as the copper oxide-reducible solutions, aqueous solutions of hydrazine, methylhydrazine, methyl alcohol, etc. can be used, and, though the treatment is possible also at normal temperature, the treatment time can be shortened by heating. In particular, at the time of reduction treatment, it is preferable to heat the solution. Moreover, the treatment time can also be shortened by increasing soldering temperature. Through such treatments, the thickness of the oxidized film on the surface of fins can be decreased to less than 100 Å.

Moreover, according to the invention, formation of oxidized film on the surface of fins can be inhibited until practical use, or in use in a car, by submitting the surface of fins to adsorption or adherence treatment of an inhibitor for rust prevention after the treatments described above, whereby the corrosion of fins due to the salt damage can even more effectively be prevented. As such inhibitors, benzotriazole (BTA), tolyltriazole (TTA) and ethylbenzotriazole and reaction products thereof with amines, carboxylic acids, etc., higher alkylamines such as dodecylamine, stearylamine, etc., mercaptobenzothiazole, and the like can be mentioned, as well as various commercial chemical products, known to be so effective. Moreover, these chemicals may be used in a form of aqueous solution or usually in solution with an organic solvent.

With the radiator assembled by the manufacturing methods of the invention as described above, corrosion due to salt damage can be suppressed by about 20 to 50% compared with conventional radiators. It is known that copper oxide usually has a protective property against aerial oxidation or sulfidizing corrosion, but it acts inversely to become the cause of the promotion in the case of corrosion due to the salt damage. It is considered that copper oxide has cracks and pores, and these act as cathodes electrochemically against the copper ground. According to the manufacturing methods of the invention, by making the thickness of oxidized film on the surface of fins of the assembled radiator to be not more than 1200 Å, corrosion due to the salt damage can effectively be prevented.

Furthermore, by using the manufacturing methods of the invention, in particular, the manufacturing method wherein the formation of the core is carried out in a nonoxidative atmosphere substantially not containing any oxygen, the thickness of oxidized film produced on the surfaces of tubes and fins in the process can be made thin and the necessary quantity of flux can be lowered. As a result, such problems as malodor and effluent contamination, the cause thereof being attributed to flux, are obviated.

Moreover, since the oxidized film produced on the surface of tubes and fins is gradually produced after soldering in an atmosphere not containing oxygen, the oxidized film is a very dense thin film and it is thus possible to make the surfaces of tubes and fins very smooth to contribute to the improvement in corrosion resistance.

The invention is illustrated by the following examples.

EXAMPLE 1

Flat brass tubes (thickness of wall: 0.12 mm, width: 10 mm, thickness: 3 mm) covered with solder and fins of corrugated thin plates (thickness: 0.04 mm, width: 8.5 mm) of Cu-0.15% Sn-0.01% P alloy were superposed and bonded with solder by fixing to an iron frame and maintained for 10 minutes at 210° C. in a nonoxidative atmosphere consisting of $N_2$-1% $H_2$. Thereafter, after having been kept for 15 minutes at the cold portion of 120° C. in the same atmosphere, they were taken out to form the core.

EXAMPLE 2

In Example 1, a nonoxidative atmosphere of 100% $N_2$ was used in place of $N_2$-1% $H_2$.

EXAMPLE 3

The core formed according to Example 1 was dipped for 1 minute into 0.25% aqueous solution of BTA and then dried.

EXAMPLE 4

The core formed according to Example 1 was dipped for 1 minute into 0.5% alcoholic solution of mercaptobenzothiazole and then dried.

EXAMPLE 5

Flat brass tubes and corrugated fins were superposed similarly as in Example 1 and bonded with solder in the atmosphere by fixing to an iron frame to form the core. Then, said core was kept for 5 minutes at 180° C. in a reductive atmosphere consisting of $H_2$-50% CO and, after having been kept for 10 minutes at the cold portion of 120° C. in the same atmosphere, it was taken out in the air for the reduction treatment of the core.

EXAMPLE 6

The core formed according to Example 5 was dipped for 1 minute into 0.25% aqueous solution of BTA and then dried.

EXAMPLE 7

From the commercial radiator manufactured by combining corrugated thin plates of Cu-0.15% Sn-0.01% P alloy with a thickness of 0.04 mm with brass tubes covered with solder and by soldering, the core with a width of 10 cm and a length of 10 cm was cut off and dipped for 10 seconds at 40° C. into 1% aqueous solution of $H_2SO_4$. Then, it was washed with water and dried.

EXAMPLE 8

Following the treatment in Example 7, the core was dipped for 5 seconds at room temperature into 0.25% alcoholic solution of BTA and then dried.

EXAMPLE 9

The core was dipped for 35 seconds at 40° C. into it aqueous solution (pH: 11.5) of EDTA, then washed with water and dried.

EXAMPLE 10

The core was dipped for 10 seconds at 40° C. into 4% aqueous solution of NaCN, then washed with water and dried.

EXAMPLE 11

Following the treatment in example 10, the core was dipped for 10 seconds at 60° C. into 0.1% aqueous solution of dodecylamine and then dried.

EXAMPLE 12

The core was dipped for 10 seconds at 80° C. into 5% solution of $NH_2$. $NH_2$ and then dried.

Conventional method

In Example 1, the bonding with solder was made in air in place of the nonoxidative atmosphere consisting of $N_2$-1% $H_2$.

Of the respective cores thus manufactured, the thickness of oxidized film on the surface of the fins was measured. Then, after repeating the spray test with 5% saline solution on the basis of JIS Z-2371 for 0.5 hours and the moistening test at a temperature of 60° C. and a humidity of 95% for 23.6 hours 40 times, a portion of fins was cut off and the amount of corrosion of fin was determined. Also, the cooling fluid was circulated through the cores manufactured by the respective methods in the examples, while the spray test with saline solution was carried out to evaluate the corrosion resistance of the tubes by measuring the time until the tubes give rise to leakage of fluid.

These results are shown in Table 1. The thickness of oxidized film on the surface of fin was measured by the cathodic reduction method, and the amount of corrosion was calculated from the difference of weights before and after the dipping when dipped for 1 minute into 5% aqueous solution of $H_2SO_4$ applying ultrasonic wave.

TABLE 1

| Manufacturing method | | Thickness of oxidized film (Å) | Amount of corrosion of fin (%) | Time until the leakage of fluid from tube (hr) |
|---|---|---|---|---|
| Example 1 | Nonoxidative Soldering | 210 | 7.3 | 730 |
| Example 2 | Nonoxidative Soldering | 390 | 7.2 | 500 |
| Example 3 | Dipping, BTA | 180 | 6.6 | 680 |
| Example 4 | Dipping, Mercapto tobenzothiazole | 180 | 6.9 | 590 |
| Example 5 | Postreduction | 160 | 6.9 | 720 |
| Example 6 | 5 + Dipping, BTA | 140 | 6.4 | 750 |
| Example 7 | Acid pickling | 80 | 7.2 | 640 |
| Example 8 | 7 + Dipping, BTA | 50 | 6.6 | 710 |
| Example 9 | Dipping, EDTA | 60 | 7.0 | 560 |
| Example 10 | Dipping, NaCN | 80 | 7.4 | 630 |
| Example 11 | 10 + Dipping, Dodecylamine | 60 | 6.85 | 670 |
| Example 12 | Dipping, Hydrazine | 60 | 7.0 | 590 |
| Conventional method | | 4200 | 12.6 | 180 |

Next, the cores in Example 1 were submitted to the oxidation treatment for 1 to 30 minutes at 350° C. in an air bath, and thereafter, the thickness of oxidized film and the amount of corrosion were measured similarly to investigate the relationship between the thickness of oxidized film and the amount of corrosion. Results are shown in Table 2.

TABLE 2

| | Time kept | | | |
|---|---|---|---|---|
| | 1 min | 2 min | 10 min | 30 min |
| Thickness of oxidized film (Å) | 800 | 1400 | 3200 | 9800 |
| Amount of Corrosion (%) | 8.1 | 9.9 | 11.9 | 15.1 |

After keeping the cores manufactured according to Example 1, 3, 4, 7, 8 and 11 and conventional method for 300 hours in a moistening state at a temperature of 60° C. and a humidity of 95%, the thickness of oxidized film was similarly measured. Then, the spray test with saline solution aforementioned and the moistening test were repeated 40 times to determine the amount of corrosion. Results are shown in Table 3.

TABLE 3

| Manufacturing method | Thickness of oxidized film (Å) | Amount of corrosion (%) |
|---|---|---|
| Example 1 | 820 | 7.9 |
| Example 3 | 350 | 7.0 |
| Example 4 | 360 | 6.9 |
| Example 7 | 1100 | 8.8 |
| Example 8 | 300 | 7.4 |
| Example 11 | 420 | 7.4 |
| Conventional method | 4200 | 12.5 |

As evident from Table 1, in the case of the conventional method, the amount of corrosion of fins is 12.5%, whereas, in Examples 1 through 12 according to the invention, it is as low as about 7% in all instances. Moreover, the time until the formation of holes in the tubes is as short as 180 hours according to the conventional method, whereas it is more than 500 hours in the examples of the invention, thus resulting in the improvement in the corrosion resistance of the tubes. Further, in Examples 1 and 2, the amount of flux used can be decreased to less than about half as compared with the amount of flux necessary in the conventional method.

Moreover, from Table 2, it can be seen that the amount of corrosion of the fins increases with increasing thickness of oxidized film on the fins and, in particular, it increases significantly in the region where the thickness of oxidized film is more than 1400 Å. Further, as evident from Table 3, in the manufacturing methods of the invention, compared with the bonding with solder in a nonoxidative atmosphere, the reduction treatment by heating in a reductive atmosphere after soldering, or only the dipping treatment into a copper oxide-dissolvable or reducible solution, when submitted further to an adsorption or adherence treatment with a rust inhibitor, the surface is hardly oxidized and the amount of corrosion becomes even less, so that deterioration of surface can be prevented due to the environment from the time of shipment of the radiator to the time of and in practical use. The effects shown by the foregoing examples are not confined to Cu-Sn alloy, but equally are obtained when alloys of Cu-Cd, Cu-Zn, Cu-Ag and others are used.

As described above, according to the invention, corrosion due to salt damage can be effectively prevented by suppressing the formation of an oxidized film in the manufacturing process, which heretofore was never considered as a problem in the usual air atmosphere, but rather, was considered to have a protective function. Thus, it has become possible to economically manufacture a high-performance radiator and at the same time lightening of the car, a significant industrial advantage.

What is claimed is:

1. In a method of manufacturing a copper radiator for automobiles characterized by assembling said radiator by fitting fins to the outside of a plurality of tubes, through which the heat-exchanging medium flows, by bonding with solder to form a copper core and fitting seat plate(s) to one end or both ends of said core by bonding with solder to connect tank(s), the improvement which comprises carrying out the soldering for forming the core in a nonoxidative atmosphere and/or heating the core in a reductive atmosphere during assembling of the radiator after soldering so that the thickness of oxidized film on the surface of the fins is not more than 1200 Å.

2. In a method of manufacturing a copper radiator for automobiles characterized by assembling said radiator by fitting fins to the outside of a plurality of tubes, through which the heat-exchanging medium flows, by bonding with solder to form a copper core and fitting seat plate(s) to one end or both ends of said core by bonding with solder to connect tank(s), the improvement which comprises submitting the core to a dipping treatment into an oxide-dissolvable or a reducible solution in the process of assembling the radiator after forming of the core so that the thickness of oxidized film on the surface of the assembly of the radiator is not more than 1200 Å.

3. A method of manufacturing a copper radiator for automobiles comprising:

assembling a radiator in such a manner that fins are connected to the outside of a plurality of tubes through which a heat-exchanging medium flows to form a copper core of the fins and the tubes and seat plate(s) is(are) connected to one or both ends of the core to connect tank(s), forming the core by soldering in a nonoxidative atmosphere, heating the core in a reductive atmosphere after soldering or dipping the core into a oxide-dissolvable or reducible solution after soldering, adsorbing or adhering on said radiator a rust inhibitor after its assembly, wherein an oxidized film is formed on an outer surface on the fins during soldering, heating and adsorbing or adhering of said rust inhibitor, and the thickness of the oxidized films is not more than 1200 Å.

4. In a method of manufacturing a copper radiator for automobiles characterized by assembling a radiator by fitting fins to the outside of a plurality of tubes through which a heat-exchanging medium flows, by bonding with solder to form a copper core of the fins and tubes and fitting seat plate(s) to one end or both of the core by bonding, with solder to connect tank(s), the improvement which comprises carrying out the soldering for the formation of the core in a nonoxidative atmosphere and/or heating the core in a reductive atmosphere during assembly of the radiator after soldering for forming of the core, and cooling the core down in a nonoxidative atmosphere, wherein the thickness of the oxidized film on the surface of the fins formed during the soldering, the reduction treatment and the cooling, is not more than 1200 Å.

5. In a method of manufacturing a copper radiator for automobiles characterized by assembling said radiator by fitting fins to the outside of a plurality of tubes, through which a heatexchanging medium flows, by bonding with solder to form a copper core of the fins and the tubes and fitting seat plate(s) to one end or both ends of said core by bonding with solder to connect tank(s), the improvement which comprises carrying out the soldering for formation of the cores in a nonoxidative atmosphere and/or heating the core in a reductive atmosphere during assembly of the radiator after soldering for forming of the core, and then, cooling the core down in a reductive atmosphere, wherein the thickness of the oxidized film on the surface of the fins formed during the soldering, the reduction treatment and the cooling, is not more than 1200 Å.

6. The method according to claim 4, including adsorbing in or adhering on said radiator a rust inhibitor after its assembly.

7. The method according to claim 5, including adsorbing in or adhering on said radiator a rust inhibitor after its assembly.

* * * * *